US010993554B2

(12) United States Patent
Carter

(10) Patent No.: US 10,993,554 B2
(45) Date of Patent: May 4, 2021

(54) DISPLAY STAND FOR ART PRINTS AND OTHER STACKABLE MEDIA

(71) Applicant: Elaine Carter, St. Cloud, MN (US)

(72) Inventor: Percy John Carter, St. Colud, MN (US)

( * ) Notice: Subject to any disclaimer, the term of this patent is extended or adjusted under 35 U.S.C. 154(b) by 0 days.

(21) Appl. No.: 16/443,989

(22) Filed: Jun. 18, 2019

(65) Prior Publication Data

US 2019/0387900 A1 Dec. 26, 2019

Related U.S. Application Data

(60) Provisional application No. 62/687,937, filed on Jun. 21, 2018.

(51) Int. Cl.
*A47F 7/00* (2006.01)
*A47F 5/10* (2006.01)

(52) U.S. Cl.
CPC ..... *A47F 7/0014* (2013.01); *A47F 5/108* (2013.01)

(58) Field of Classification Search
CPC ..... A47F 7/0014; A47F 5/108; A47B 63/02
USPC ..... 211/45, 201, 198, 100
See application file for complete search history.

(56) References Cited

U.S. PATENT DOCUMENTS 244,215 A * 7/1881 Fenby ..... A47C 9/105 108/118
1,683,675 A * 9/1928 Howe ..... A47F 5/108 248/150
2,163,866 A * 6/1939 Bitney ..... A47F 5/108 248/150
2,787,310 A * 4/1957 Zerbe ..... D06F 5/004 220/9.3
2,948,410 A * 8/1960 Maddox ..... A47F 7/06 108/163
3,033,379 A * 5/1962 Clark ..... D06F 57/08 211/200
3,136,272 A * 6/1964 Sprigman ..... A47C 4/286 108/118
3,471,960 A * 10/1969 Taub ..... A47F 3/14 40/308
3,593,768 A * 7/1971 Taub ..... A47F 5/108 206/466
3,635,520 A * 1/1972 Roher ..... A47C 4/286 297/45
4,789,070 A * 12/1988 Bennett ..... D06F 57/08 211/200

(Continued)

FOREIGN PATENT DOCUMENTS

FR 2127051 A5 * 10/1972 ..... A47F 7/14
FR 2620920 A1 * 3/1989 ..... A47F 5/108
GB 803540 A * 10/1958 ..... A47B 63/00

*Primary Examiner* — Stanton L Krycinski
(74) *Attorney, Agent, or Firm* — Greg N. Geiser; Gutwein Law

(57) ABSTRACT

A portable stand configured to provide support for the display of art prints and other flattened media, wherein a user is able easily flip through supported items on the stand. The stand including a collapsible/extensible leg portion movable from a collapsed position to an extended position and configured to removably receive a sling portion. The sling portion comprised of a flexible material extending loosely between ends of the device, wherein the sling portion provides resting support to the items placed within the device.

5 Claims, 6 Drawing Sheets

(56) References Cited

U.S. PATENT DOCUMENTS

| | | | | | |
|---|---|---|---|---|---|
| 4,823,965 | A * | 4/1989 | Hughes | F24B 1/199 | 211/60.1 |
| 4,976,406 | A * | 12/1990 | Buckley | B62B 1/14 | 248/98 |
| 6,073,894 | A * | 6/2000 | Chen | A47J 37/0786 | 108/115 |
| 6,247,749 | B1 * | 6/2001 | Yu | A47C 4/286 | 297/16.2 |
| 6,454,348 | B1 * | 9/2002 | Wu | A47C 4/286 | 297/16.2 |
| 6,499,705 | B1 * | 12/2002 | Tsai | F16M 11/22 | 211/200 |
| 7,100,877 | B2 * | 9/2006 | Bourke | A47B 37/04 | 108/118 |
| 7,296,699 | B2 * | 11/2007 | Hung | A47B 47/005 | 211/182 |
| 7,389,887 | B2 * | 6/2008 | Liang | A47B 43/00 | 211/149 |
| 7,681,267 | B1 * | 3/2010 | Hall | A47D 5/006 | 5/115 |
| 8,342,342 | B1 * | 1/2013 | Vandelaar | D06F 57/12 | 211/198 |
| D699,492 | S * | 2/2014 | Day | D6/368 | |
| D752,890 | S * | 4/2016 | Akkad | D6/368 | |
| 2007/0251907 | A1 * | 11/2007 | Li | A47B 3/087 | 211/195 |

* cited by examiner

DISPLAY STAND FOR ART PRINTS AND OTHER STACKABLE MEDIA

CROSS-REFERENCE TO RELATED APPLICATION

This Patent Application claims priority to U.S. Provisional Application: 62/687,937 filed Jun. 21, 2018 to the above-named inventor, the disclosure of which is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to a display stand for art prints and stackable media. In one aspect, the invention relates to a collapsible stand configured to support art prints and stackable media in a position for easy viewing, wherein a user is easily able to flip through a stack of prints or media.

BACKGROUND

In the retail industry, it is known that the sale of art prints generally requires one to display the prints for viewing by a potential purchaser. A typical solution to display these prints is to hang the prints on a surface, such as a wall for viewing. Yet another typical solution is to display these prints and other flattened media on a table or other flattened surface in a stacked or splayed configuration. Still another seeks to display these prints onto a dedicated stand, such as an easel.

Therefore, there exists a need within the marketplace for an improved assembly to display art, prints, and other flattened media for viewing in a retail environment. Preferably this assembly provides for the display of several items in a configuration that allows for easy browsing by flipping through the flattened media. Further, it is preferred that this assembly is easily collapsible and foldable into a compact assembly for easy set up and take down after use.

BRIEF SUMMARY OF THE INVENTION

In one aspect, this disclosure is related to an improved assembly for the display of art, prints, and other flattened media in.

In another aspect, this disclosure is related to a collapsible stand and flexible holder configured to receive flattened items for display and browsing by a customer that allows the customer to easily flip through individual items while viewing.

In another aspect, this disclosure is related to collapsible stand comprised of a plurality of legs in a hinged assembly and an upper sling portion configured for removable receipt on an end of the plurality of legs. The plurality of legs coupled together in a movable assembly, wherein they are movable cooperatively from a collapsed position to an expanded position to form a generally rectangular base portion. The upper sling portion having a first connecting portion and a second connecting portion received on a pair of opposed legs and a sling member received on the first connecting portion and second connecting portion extending between the connecting portions to generally provide resting support for displayed materials.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
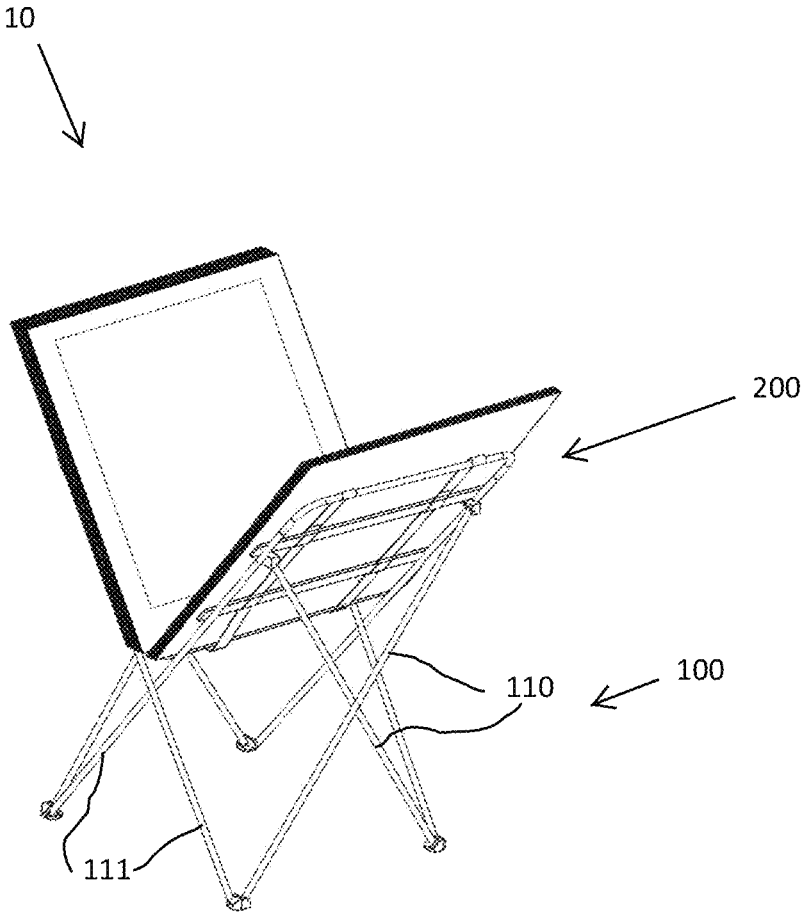
FIG. 1 is an isometric view of the device with displayed media, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The device of the present disclosure is most generally related to a collapsible/expandable stand for the display of art prints and other stackable media. The device is configured for ease of use and compaction, wherein it can be easily assembled into a durable and firm structure in an expanded state and disassembled into a compact structure configured for placement into a container, such as a bag, for easy storage and transport.

Figure 2:
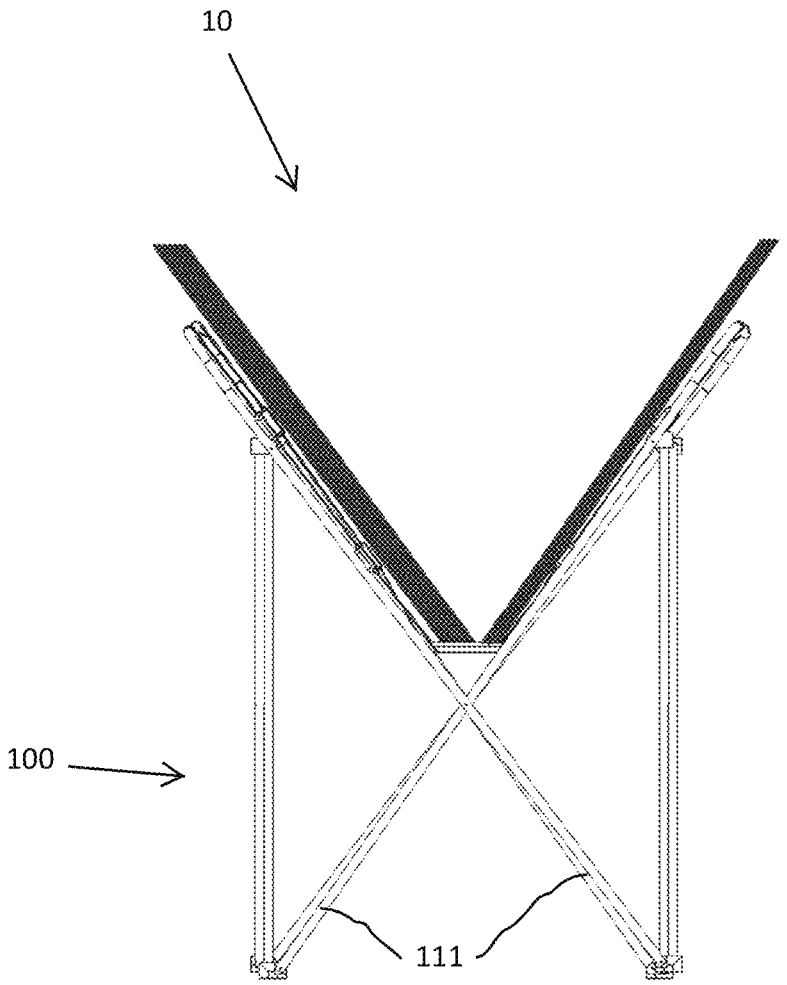
FIG. 2 is a side view of the device with displayed media, according to the present disclosure.
Figure 3:
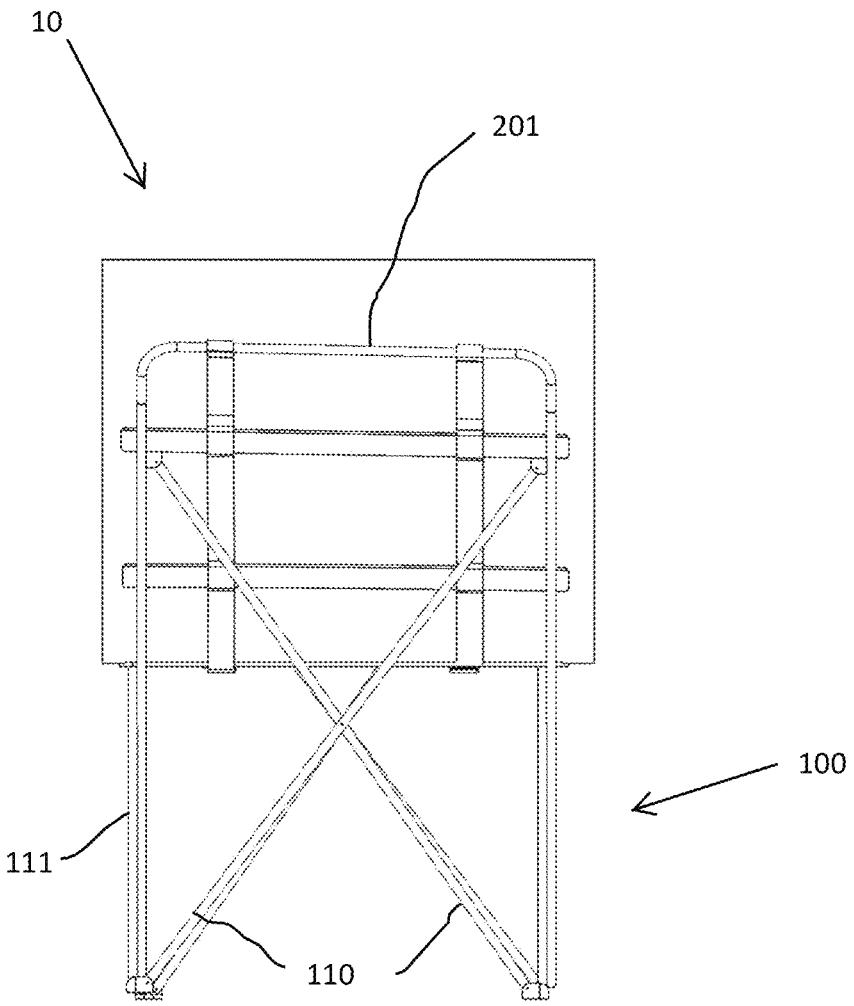
FIG. 3 is a front view of the device with displayed media, according to the present disclosure.
Figure 4:
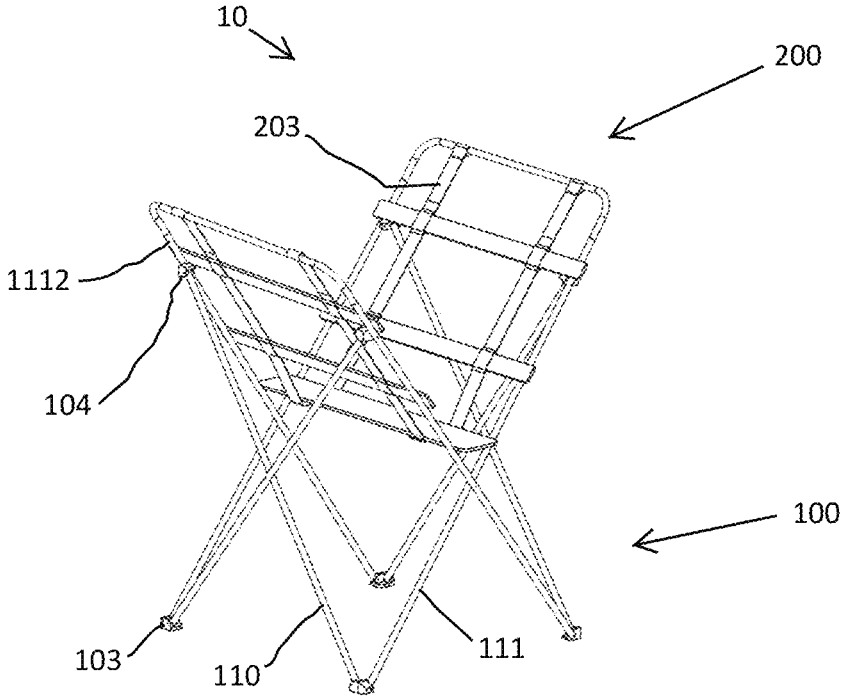
FIG. 4 is an isometric view of the device, according to the present disclosure.
Figure 5:
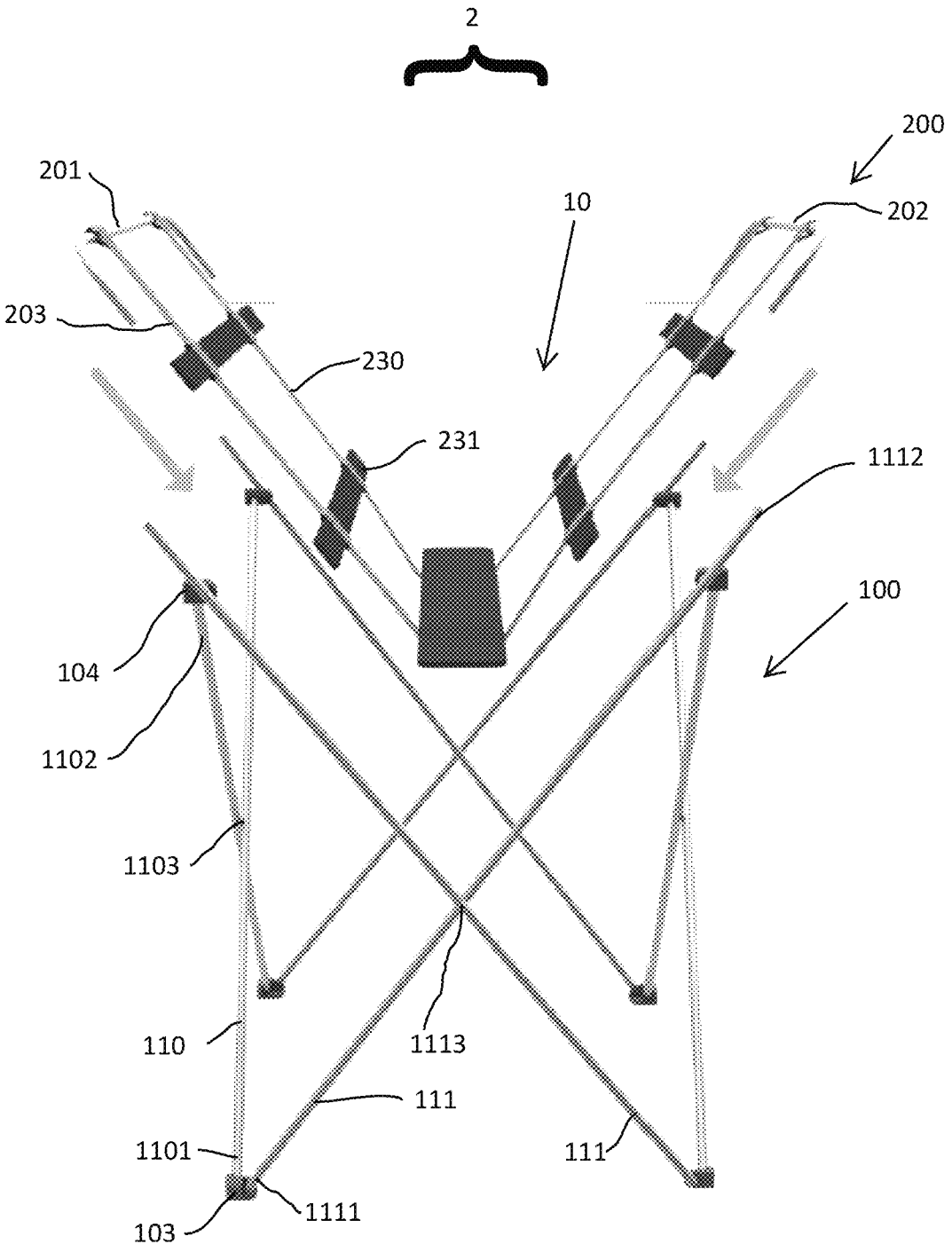
FIG. 5 is an expanded an isometric view of the device, according to the present disclosure.
Figure 6:
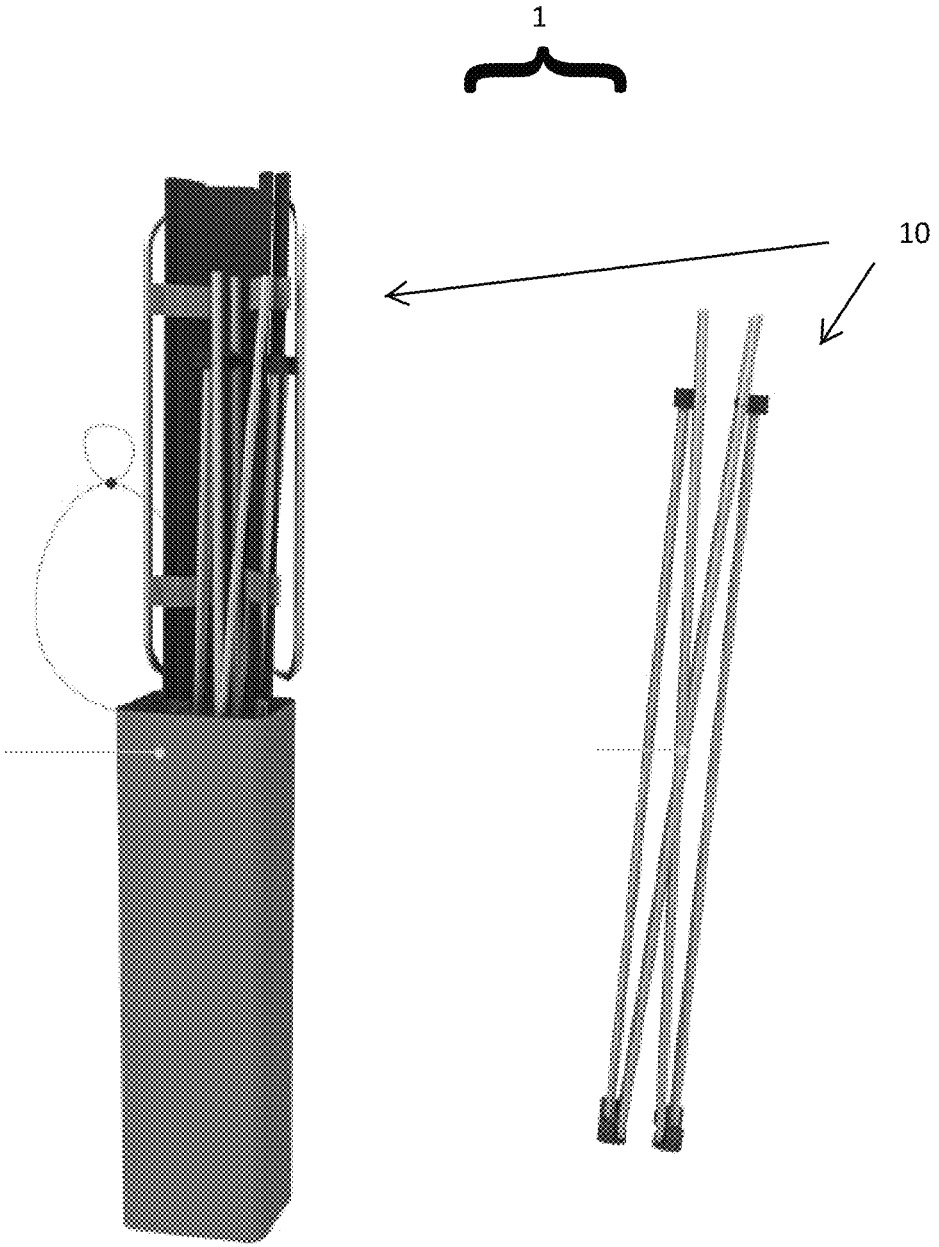
FIG. 6 is a view of the device in a collapsed position and received within a storage container, according to the present disclosure.

Referring now to FIGS. 1-6 of the of the display stand device of the present disclosure, generally referred to as device 10. The device 10 is most generally comprised of two major structural elements provided in a cooperative assembly in the form of a collapsible/extensible leg portion 100 and an upper sling portion 200 that are coupled together. The collapsible/extensible leg portion 100 comprising a plurality of legs 101 in an assembly movable from a collapsed position 1 to an extended position 2.

In the preferred embodiment of the present disclosure the collapsible/extensible leg portion 100 plurality of legs 101 is provided in a hinged assembly wherein the plurality of legs 101 are comprised of four end supports 110 and four cross members 111. The four end supports 110 generally provided in a configuration, wherein a first pair of end supports 110 are positioned at an opposed end of the device 10 opposite a second pair of end supports 110. The four cross members 111 provided in a configuration, wherein a first pair of cross members 111 are positioned opposite a second pair of cross members 111, with each pair of cross members 111 generally connecting the first pair of end supports 110 to the second pair of end supports 110 at a first side of the end supports 110.

The four end supports 110 and four cross members 111 are coupled together in a cooperative assembly to form the collapsible/extensible leg portion 100 for folding and expansion. Accordingly, a lower end portion 1101 of the end supports 110 is coupled to a corresponding lower end 1111 of the cross members 111 at a foot 103 and an upper end portion 1102 of the end supports 110 is coupled to a corresponding upper end 1112 at a connector 103, wherein the pair of end supports 110 crisscross at their respective opposed ends in a hinged coupling 1103 and the pair of cross members 111 crisscross at their respective opposed sides in a hinged coupling 1113. Accordingly, the collapsible/extensible leg portion 100 has four feet 103 and four connectors 104 in a generally rectangular assembly that is capable of folding and extending.

The upper sling portion 200 includes a first end 201 and second end 202 with a sling 203 coupled to and extending between the first end 201 and the second end 202. The sling 203 comprised of a flexible material, such as, but not limited to, a fabric, extending loosely opposite the first end 201 and second end 202 towards the feet 103. The sling 203 may be comprised of a single material extending a width of the device 10 or may be comprised of multiple strap like members. In the preferred embodiment of the present disclosure, the sling 203 is comprised of a pair of straps 230 with slats 231 coupled between each strap of the pair of straps 230 between the width of the device. Preferably, the device includes five slats with a central slat 232 positioned centrally along a length of the pair of straps and a pair of slats 231 evenly spaced along the length exterior to the central slat 232.

The first end 201 and the second end 202 of the upper sling portion 200 are configured for removable attachment at the upper end 1112 of opposed cross members 111, wherein the first end 201 is positioned in an alignment with the first pair of end supports 110 and the second end 202 positioned in an alignment with the second pair of end supports 110 to generally extend across the device 10.

In the preferred embodiment of the present disclosure, the end supports 110 and cross members 111 are comprised of a tubular material having an interior space. Accordingly, the first end 201 and the second end 202 having a recessed portion configured for receipt within the interior space of the tubular material in a mated assembly.

In use of the device 10, a user will remove the device 10 components in the form of the collapsible/extensible leg portion 100 and an upper sling portion 200 from a carry case 3. The user will then set up the device 10 by moving the collapsible/extensible leg portion 100 to its extended position 2 by generally separating the plurality of legs 101. After securing the separation, the user will place the first end 201 of the sling portion 200 onto a first side of the collapsible/extensible leg portion 100 and place the second end 202 of the sling portion 200 onto a second side of the collapsible/extensible leg portion 100, wherein the sling 203 will loosely extend between the first end 201 and the second end 202 forming a surface for the placement of the artwork to be displayed. The process is generally reversed to disassemble the device 10, wherein the collapsible/extensible leg portion 100 is moved to the collapsed position 1 and placed back into the carry case 3.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A display stand device for art and other flattened media, the display stand being portable and provided in an assembly, the device comprising:

a collapsible/extensible leg portion comprising a plurality of legs, the plurality of legs comprising:

a first pair of end supports positioned at a first end of the device;

a second pair of end supports positioned at a second end of the device opposite the first pair of end supports;

a first pair of cross members positioned at a first side of the device and hingedly coupled to the first pair of end supports and the second pair of end supports, each cross member of the first pair of cross members having an upper end, the upper end defining a hollow interior space;

a second pair of cross members positioned at a second side of the device opposite the first pair of cross members and hingedly coupled to the first pair of end supports and the second pair of end supports, each cross member of the second pair of cross members having an upper end, the upper end defining a hollow interior space; and a sling portion, the sling portion comprising:

a first end, the first end having a recessed portion removably received within the hollow interior space of the upper end on the opposed cross members at the first end of the device;

a second end, the second end having a recessed portion removably received within the hollow interior space of the upper end on the opposed cross members at the second end of the device; and a sling, the sling coupled to the first end extending loosely opposite the first end to a coupling on the second end, wherein the sling provides resting support to the items placed within the device.

2. A device as in claim 1, wherein the sling is comprised of a single material.

3. A device as in claim 1, wherein the sling is comprised of a fabric.

4. A device as in claim 1, wherein the sling is comprised of a pair of straps.

5. A device as in claim 4, wherein the sling portion includes slats, the slats extending perpendicular to a length of the sling across a width of the sling between each strap of the pair of straps.

* * * * *